United States Patent [19]

Stephens

[11] 4,234,183

[45] Nov. 18, 1980

[54] GAME DEVICE

[76] Inventor: Donald J. Stephens, P.O. Box 630, Roberta, Ga. 31078

[21] Appl. No.: 961,193

[22] Filed: Nov. 16, 1978

[51] Int. Cl.[2] ..... A63B 65/12

[52] U.S. Cl. ..... 273/318

[58] Field of Search ..... 273/95 R, 95 H, 96 R; 272/143, 142, 137

[56] References Cited

U.S. PATENT DOCUMENTS

| | | | |
|---|---|---|---|
| 1,551,459 | 8/1925 | Blakoe | 272/137 |
| 1,989,484 | 1/1935 | Maryfield et al. | 273/95 R X |
| 3,342,491 | 9/1967 | Padovani | 273/96 R |

FOREIGN PATENT DOCUMENTS

| | | | |
|---|---|---|---|
| 27679 | of 1908 | United Kingdom | 273/96 R |

*Primary Examiner*—Charles E. Phillips

*Attorney, Agent, or Firm*—Gerald R. Hershberger

[57] ABSTRACT

My novel game apparatus is herein disclosed. The apparatus comprises a central generally rectangularly outlined net portion having obliquely outlined comfort handles disposed at each end. A centrally positioned ball locating opening is provided in the net portion between the handles. A player can comfortably and quickly propel and receive a suitable ball by imparting the proper movements to the device due to the novel shape of the handles without placing undue strain on the player's body and arms. The device can be used in various team and individual competitive games, both indoors and outdoors. The device is fabricated out of readily available and inexpensive materials and is suitable for low-cost manufacturing and distribution in volume.

3 Claims, 5 Drawing Figures

GAME DEVICE

BACKGROUND OF THE INVENTION

1. Field of the Invention

This invention relates to a novel hand-operated game apparatus for throwing and catching a ball while playing any of several games.

Games that require manual dexterity and manipulation have always been of great interest. These games offer the opportunity to develop skills that afford much satisfaction and pleasure to the player (and the spectators). They also promote good physical conditioning and health.

Generally, the simpler the equipment needed to play a game, the more quickly and widely will it be accepted. Of these games, those that require the throwing and catching of a ball have always enjoyed considerable popularity. Some of this type require equipment for propelling a ball, such as a glove or net. Usually, the participants alternately assume the offensive and defensive positions.

Accordingly, it is an object of the present invention to provide an easily-constructed and economical manually-operated device for both propelling and receiving a ball, which can be used by a person of average athletic ability. The device can be used for many different types of games, involving single players or teams of players, ranging from a modified form of handball to a team resembling lacrosse. Some of the possible games are suitable for outdoor play, while others can be played indoors. Thus the present device is quite versatile.

2. Description of the Prior Art

The securing of a meshed net to a handle or handles or stick has been accomplished hitherto by placing the handles substantially square to the ends of the net and by utilizing a solid net or a complicated net structure having metal stiffeners at the center thereof for securing the net thereto. The above structural limitations of the prior art render these devices cumbersome and unwieldy to operate, and expensive to manufacture. The prior devices, in many instances are not suitable for use by persons of average athletic ability, or by younger adults or children. The complexity of design and other drawbacks of the prior disclosures are believed to contribute to the lack of utility that has prevented such devices from becoming acceptable to the sports minded public.

SUMMARY OF THE INVENTION

Accordingly, it is an object of the present invention to provide an easily-constructed and economical manually-operated device for both propelling and receiving a ball, which can be used by a person of average athletic ability. The device can be used for many different types of games, involving single players or teams of players, ranging from a modified form of handball to a team resembling lacrosse. Some of the possible games are suitable for outdoor play, while others can be played indoors. Thus the present device is quite versatile.

It is a further object of my invention to provide novel obliquely outlined handles at each end of the present device to accommodate the holding of the net for throwing and catching a ball.

It is a further object of this my invention to provide a non-metallic reinforced central opening in said net for locating and positioning a ball for throwing.

It is another object of this my invention to provide a strong, durable handle suitably contoured to be held easily and comfortably in the hands for positioning the net at the correct angle for throwing the ball.

It is a further object of this my invention to provide a handle molded in one piece out of thermosetting plastic or rubber material.

It is another object of this my invention to provide a game apparatus comprising a central net portion of generally rectangular outline having obliquely outlined and hand contoured handles at both ends of such net portion and a centrally positioned reinforced ball locating opening in the net portion between such handles.

BRIEF DESCRIPTION OF THE DRAWING

Other and further objects of the present invention may be better understood and numerous other features and advantages thereof will become apparent to those skilled in the art by reference to the accompanying drawing wherein like reference numerals refer to like elements in the various figures in which.

DESCRIPTION OF THE PREFERRED EMBODIMENT

Figure 1:
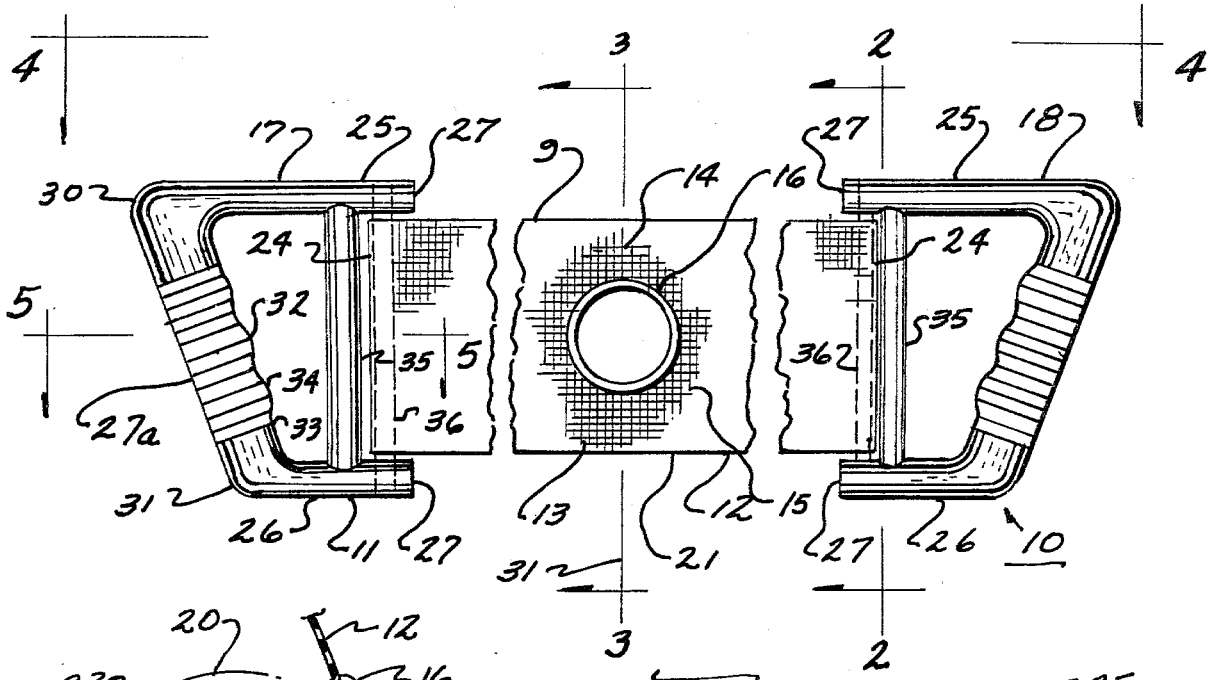
FIG. 1 is an elevational view of my game device taken in the direction of arrows 1—1 of FIG. 2.
Figure 3:
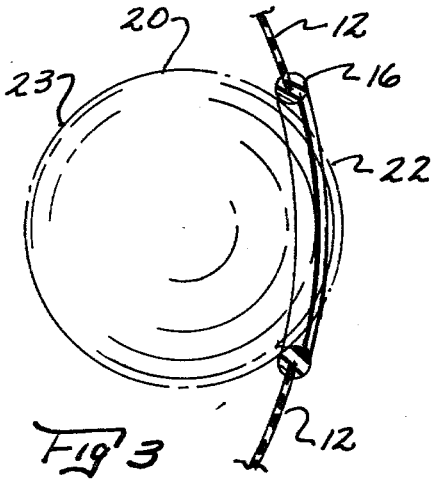
FIG. 3 is a sectional view of the ball retaining opening taken along sectional lines 3—3 of FIG. 1.

Referring now in detail to the drawing, particularly to FIG. 1 thereof, my game device is denoted generally by the numeral 10. It is shown as including an elongated ball propelling and throwing means or apparatus 11, having a central net portion 12 of substantially rectangular outline that is fabricated from nylon or other suitable material having properties of strength and durability. The net portion or open mesh portion 12 has small size openings 13 formed by the horizontal cords or strands 14 and vertical strands or cords 15, said openings being substantially smaller than the diameter of a playing ball 20, such as a tennis ball, to prevent such a ball from passing through the net. An annular or circular opening 16 is provided substantially in the center of said net both vertically and horizontally endwise between handles 17 and 18 and elevation-wise between the upper edge 9 and lower edge 21 of said net, said ball opening being substantially smaller in outline than the outline of a selected playing ball, or tennis ball, but large enough to allow a substantial portion 22 or part of the ball to be seated therein for purpose of helping to position said ball in the net without allowing the larger portion 23 of the ball to pass therethrough when caught in the net.

A reinforcing member 23 fabricated of a flexible, tough, non-metallic material such as plastic or heavy cloth is sewn or otherwise fixedly fastened around the periphery of said ball opening to hold the ends of the mesh cords together and to strengthen said nylon or other material to prevent the repetitious constant propelling and catching of the ball from wearing out or enlarging the ball opening.

The symmetrically outlined substantially planar handles 17 and 18 are positioned to extend outwardly from the ends 24 of said net. The handles are preferably molded in one piece out of a thermo-setting plastic or rubber material. Each handle is comprised of an upper elongated annular or cylindrical cantilevered arm portion 25 and a lower elongated annular or cylindrical arm portion 26 which is substantially parallel to and shorter in length than the upper arm portion and whose inner end 27 is in substantial vertical alignment with the inner end 28 of said upper arm portion 25.

The upstanding grip portion 27*a* of said handle is inclined or biased inwardly from the upper outer end 30 of said upper arm portion 20 to the lower outer end 31 of said lower arm portion to form an acute angle with said upper arm and an obtuse angle with said lower arm. The purpose of biasing the grip inwardly at the bottom thereof is to aid in preventing wrist strain when using the game. Said grip portions have molded finger grips 32 forming four indentations 33 and three protrusions 34 fitting the four fingers of the hand comfortably, and to assist in holding said handles and net securely when in use.

An annular, elongated vertical cylindrical handle brace 35 may be fixedly connected inwardly between said upper and lower arm to give added support to said handle.

Figure 2:
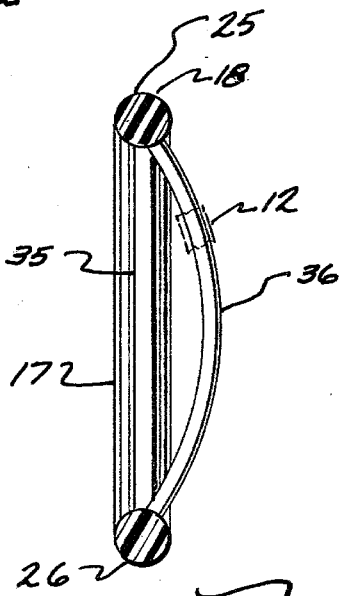
FIG. 2 is a partially sectioned end view of my device taken in direction of arrows 2—2 of FIG. 1.
Figure 5:
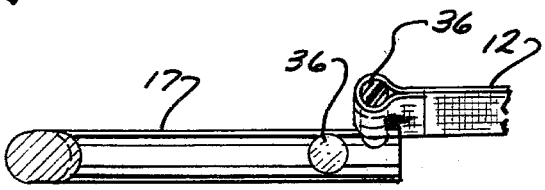
FIG. 5 is a horizontal section of the handle taken in direction of arrows 5—5 of FIG. 1.

The net is attached to the handle by means of a substantially planar vertical elongated arm or pin 36 which has a generally annular or circular cross-section as shown in FIG. 5 and is arcuately shaped or bowed in a plane substantially normal to the plane of the handle and fixedly attached at each end to cantilevered arm portions 24 and 25 adjacent the ends thereof as shown in FIGS. 2 and 5, although a straight pin may be utilized if desired.

Figure 4:
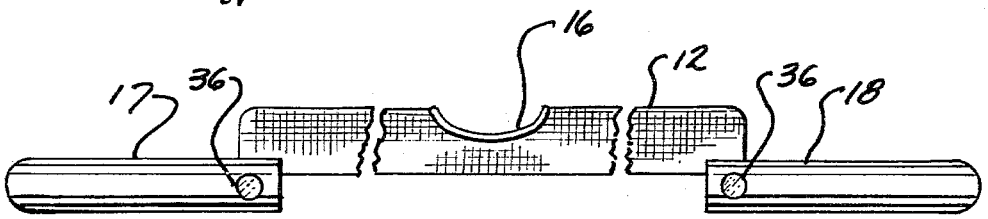
FIG. 4 is a plan view of the present device taken in the direction of arrows 4—4 of FIG. 1.

The ends 24 of the net are threaded between handle brace 35 and arm member 36, looped around the arm member, and each end attached to itself by sewing, rivets (not shown) or other equivalent method. When the preferrably arcuately shaped arm is utilized it imparts a similar curved shape to the flexible net, as shown in FIGS. 2 and 4 to assist the opening 16 in retaining the ball in the net during play. The arm may be made removable instead of fixed to said upper and lower members if desired. The brace may be eliminated and the arm serve as both a support for the net and a brace for the upper and lower arms if desired.

In operation, the player grasps the handles with the grip portion depending downwardly and inwardly and pulls them to their widest possible separation. He then orients the net portion so that it intercepts the path of a propelled ball. When the ball contacts the net, the player quickly brings the handles adjacent each other, so that the ball may be retained in the ball ring in the center of the net, which has now been folded in half along its transverse centerline.

To propel the ball, the player rapidly spreads the handles to their widest spacing in a sharp motion that draws the net to a taut position. This rapid motion, and the resilience of the net, imparts a force on the ball that ejects it rapidly from the net. It is therefore apparent, that having means for both throwing and catching a ball, various competitive games can be devised.

Many modifications may be made by those who desire to practice the invention without departing from the scope thereof, which is defined by the following claims:

I claim:

1. In a game apparatus utilizing a ball, comprising, in combination, a central net portion of generally rectangular outline adapted to catch a ball including relatively short fastener ends and relatively long horizontal edges;

a pair of complementary substantially planar handles adapted to be connected to opposite fastener ends of said net each including a horizontally elongated upper cantilevered arm portion having an inner end and an outer end, a lower horizontally elongated cantilevered arm portion substantially shorter than said upper arm portion having an inner end and an outer end, with the inner ends of said arms positioned in substantially vertical alignment with each other, and a hand grip portion connected fixedly to said upper arm portion outer end, depending downwardly, obliquely inwardly at an angle arranged and adapted to minimize wrist and arm strain when catching and propelling a ball to a fixed connection with said lower arm portion outer end;

and a vertically arranged elongated traverse pin member fixedly attached between said upper and said lower arm member adjacent their inner ends, said pin arcuately bowed centrally in a plane substantially normal to the handle plane to connect the fastener ends of the net in arcuate relationship to said handles.

2. In a game apparatus, comprising, in combination, a central net portion of generally rectangular outline having an annular ball receiving opening positioned substantially centrally from the ends and from the edges thereof, said opening having a reinforcing member fixedly fastened about the periphery thereof to bind the edges of said net together and to prevent spreading and wearing and tearing of the net when receiving or repelling the ball;

a pair of complementary substantially planar handles connected to opposite ends of said net including a horizontally elongated upper cantilevered arm portion having an inner end and an outward end, a lower horizontally elongated cantilevered arm portion substantially shorter in length than said upper arm portion having an inner end and an outer end, the inner ends of said arms positioned in substantially vertical alignment with each other, and a hand grip portion connected fixedly to said upper arm portion outer end, depending downwardly, and angled obliquely inwardly to connect said lower arm portion to a fixed connection with said lower arm portion, said handle grip angle arranged and adapted to assist the operator in holding said net substantially horizontal helping to prevent undue strain on the wrists and arms of the operator when catching and propelling a ball;

and a vertically arranged elongated traverse pin member fixedly attached between said upper arm member and said lower arm member connecting said handles to the ends of said net adjacent said arm member inner ends mutually bracing said upper and lower arms, said handle bracing and net holding pin being arcuately bowed substantially centrally in a plane substantially normal to the handle plane to connect the ends of the net in an arcuate relationship to said handles.

3. The device as set forth in claim 3, said handle grip portion having inwardly directed finger grip indentations to ease the fingers, hands, and wrists when using the device.

* * * * *